United States Patent [19]

Sargis

[11] 4,173,103

[45] Nov. 6, 1979

[54] LIGHT-WEIGHT STRUCTURAL SYSTEM AND MODULAR CONCRETE BUILDING COMPONENTS THEREFOR

[76] Inventor: Sargis E. Sargis, 6195 Springer Way, San Jose, Calif. 95123

[21] Appl. No.: 801,217

[22] Filed: May 27, 1977

Related U.S. Application Data

[62] Division of Ser. No. 529,344, Dec. 4, 1974, Pat. No. 4,041,666.

[51] Int. Cl.[2] ..... E04B 2/00

[52] U.S. Cl. ..... 52/79.13; 52/227; 52/234; 52/262

[58] Field of Search ..... 52/262, 204, 81, 222, 52/259, 600, 604, 606, 308, 596, 219, 127, 251, 583, 584, 405, 406, 227, 206, 79.11, 79.14, 79.2, 79.7, 582, DIG. 10, 250, 252, 227, 79.13, 234

[56] References Cited

U.S. PATENT DOCUMENTS

| | | | |
|---|---|---|---|
| 1,036,384 | 8/1912 | Turner | 52/251 |
| 1,819,405 | 8/1931 | Brooks | 52/584 |
| 2,592,634 | 4/1952 | Wilson | 52/583 |
| 2,645,114 | 7/1953 | Amirikian | 52/432 |
| 3,197,927 | 8/1965 | Fuller | 52/81 |
| 3,226,894 | 1/1966 | Bruchardt et al. | 52/227 X |
| 3,289,366 | 12/1966 | Abrams | 52/259 X |
| 3,369,334 | 2/1968 | Berg | 52/227 |
| 3,455,075 | 7/1969 | Frey | 52/604 X |
| 3,480,312 | 11/1969 | Meredeth | 52/582 |
| 3,494,092 | 2/1970 | Johnson et al. | 52/583 X |
| 3,632,109 | 1/1972 | Dattner | 52/DIG. 10 X |
| 3,775,240 | 11/1973 | Harvey | 52/206 |
| 3,841,039 | 10/1974 | Farnsworth | 52/222 X |
| 3,861,102 | 1/1975 | Hodge | 52/236.3 |
| 3,885,367 | 5/1975 | Thumberg | 52/127 |
| 3,898,777 | 8/1975 | Georgiev | 52/583 |
| 4,012,881 | 3/1977 | Martivadonna | 52/604 |
| 4,041,666 | 8/1977 | Sargis | 52/405 |

FOREIGN PATENT DOCUMENTS

| | | | |
|---|---|---|---|
| 804117 | 4/1951 | Fed. Rep. of Germany | 52/323 |
| 1456024 | 9/1966 | France | 52/79.7 |
| 330735 | 8/1958 | Switzerland | 52/583 |
| 637274 | 5/1950 | United Kingdom | 52/251 |

*Primary Examiner*—Alfred C. Perham
*Attorney, Agent, or Firm*—Keil & Witherspoon

[57] ABSTRACT

A light-weight modular building component of conventional concrete, formed by a unitary or composite rectangular panel having transversely therethrough at least a large central opening--and also a set of relatively small openings disposed peripherally thereabout; and various multi-planar structural systems embodying this kind of panel design.

3 Claims, 12 Drawing Figures

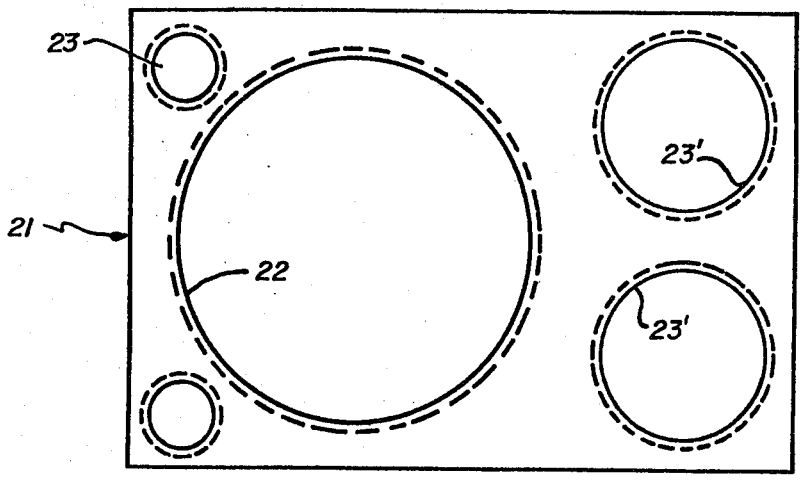
FIG. 2
FIG. 3
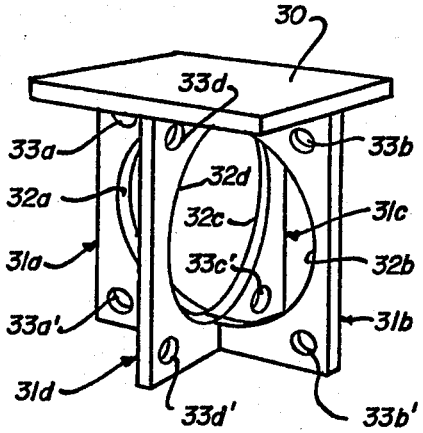
FIG. 4
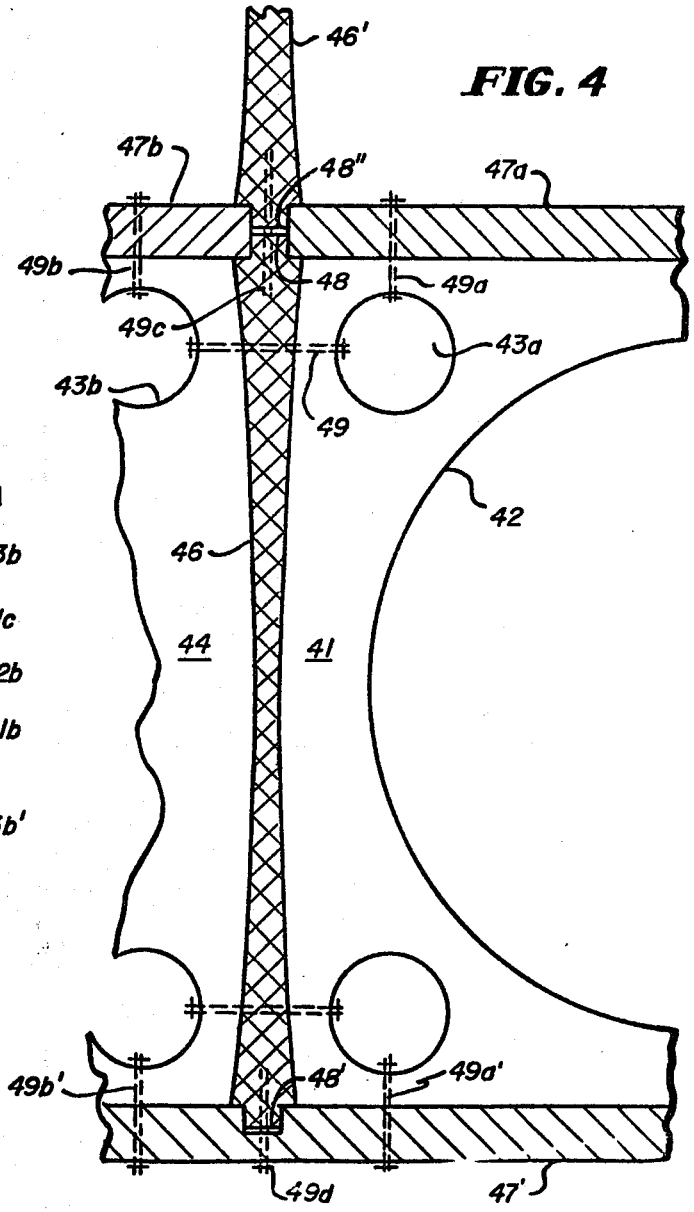

51-1
51-2
51-3
51-4
51-c
51-f
51-e
51-d
51a
51b
52a
52b
53
56
56
59
55
58
51a
54
58
54
58
55''
54'
57
55'

LIGHT-WEIGHT STRUCTURAL SYSTEM AND MODULAR CONCRETE BUILDING COMPONENTS THEREFOR

This is a division, of application Ser. No. 529,344, filed Dec. 4, 1974, now U.S. Pat. No. 4,041,666.

BACKGROUND OF THE INVENTION

The invention relates to light-weight structural systems and more particularly to modular building components of concrete that lend themselves for use in such systems.

In the past, light-weight concrete structures have frequently been formed of concrete composed of light-weight aggregates such as expanded clay or other specially treated and processed aggregates. However, the production of these aggregates is often limited by local conditions and resources and it also calls for considerable capital investment. Thus, except in the rare instances where the conditions and resources of the locality in question satisfy the fabrication requirements of aggregates of the aforementioned kind the production of light-weight concrete from such aggregates is likely to result in higher cost of the finished product.

Another approach to reducing the weight of concrete structures has been by resorting to the double-core or sandwich system. However, this system, too, has its limitations as it involves the casting of thin concrete cores and the use of very fine aggregates, special additives and reinforcements. The use of this type of system, therefore, also tends to increase the cost of the finished product. Moreover, the process may give rise to certain technical problems such as shrinkage and the development of cracks under certain climatic conditions and for this reason the use of the process may not prove to be practical or economically advisable in countries where such climatic conditions exist.

Other light-weight porous concretes are generally used for non-structural purposes but are not suitable for use in structural systems.

OBJECTS AND SUMMARY OF THE INVENTION

It is accordingly the principal object of the invention to provide light-weight structural systems and modular building components suitable for use in such systems, which are susceptible to a wide range of applications and in which the aforementioned limitations of the prior art are avoided. Generally speaking, this object is attained by the employment of structural components which because of their configuration are of high strength and at the same time of light weight. Otherwise expressed, the vertical and horizontal forces involved are taken up by compression and tension members of a design such as to provide maximum strength for a minimum amount of material used.

More particularly the invention, in one aspect thereof, consists in a modular building component in the form of a rectangular—for example square—concrete panel with a relatively large central opening and with a number of relatively small peripheral openings thereabout, all extending transversely therethrough, and with these large and small openings being dimensioned so as to substantially reduce the weight of the panel and yet permit effective distribution of vertical and horizontal forces. The small openings may further be used for the additional purpose of securing the various panels of a structural system to each other, or to other system components, such as for example a foundation, by means of steel ties. Preferably steel reinforcements are provided in the concrete circumferentially about each of the aforementioned large and small openings. The former may be closed by covers so that at least some of the space between the covers may be filled with light-weight insulating material. The rest of the opening in its center may be set aside for a window.

It may be mentioned at this point that a concrete panel having a single transverse opening cut therein is known per se.

In one implementation of the above aspect of the invention the modular panel is a composite made from a number, such as two or four, of individual arcuate sections which are assembled end to end. Terminating members such as steel plates are secured, for example by welding, to the ends of the part-circumferential steel reinforcements embedded in each of the arcuate sections and the steel plates of abutting arcuate sections in turn are welded together to secure these sections to each other.

According to another aspect of the invention the foregoing panel design principles, in the form described or in a modified form, may be extended to form the basis of a three-dimensional or multiplanar structural system. Such a "space" system may be realized, for example, by two rectangular panels—of which at least one may be of unitary construction—extending in mutually perpendicular intersecting planes, each of the half-portions of each panel having two small openings in its corners and the two half-portions of each panel together defining a large opening therethrough. A slab carried by the two mutually perpendicular panels may overlie, and be carried by, the two panels in a third plane.

In an alternative embodiment of the "space" system two coplanar—unitary or composite—rectangular panels of the general kind described above may be assembled back to back and at least one additional panel member may be joined to the two coplanar panels along the line of juncture of these panels in a plane perpendicular thereto. One or more slabs extending in a third plane may be placed above or below the foregoing panel structure to be carried thereby or form the base thereof. The two coplanar panels may be secured to each other and/or to the slab or slabs by means of steel ties terminating in adjacent small openings of the two panels; and in addition dovetailing may be provided between the slabs and the panel members.

Another modification of the "space" system provides for one or more column members having panel elements in mutually intersecting planes, one of the panel elements of at least one of the column members being joined to a series of coplanar modular building components designed according to the principles described above. The column members may have an L-shaped, T-shaped or cruciform cross section, for example. The combined structure may be designed to carry a horizontal slab.

Yet another modification of the "space" system consists in the provision of a capital member of concrete in which a number of arcuate panel sections are formed integrally with a central portion of that member to extend radially therefrom in mutually intersecting planes. Each of the arcuate panel sections is shaped to form, when complemented by other like sections in the same plane, say, a square panel with a central transverse opening. The above-mentioned central portion of the capital member may have a cavity extending coaxially therethrough, and other small cavities for accommodating poststressing bars or the like which may be used for holding the capital member in place in the structural system.

The term "capital member" as used herein is meant to encompass members of general "capital" shape which have their narrow end either at the bottom—as they do in the more limited meaning of the term—or at the top, in which latter case the members are, more strictly, in the nature of base members. In fact, pairs of relatively inverted "capital members" of the kind described in the preceding paragraph can be used together in the same structural system. In this case, the various quarter-panel sections of the lower member of a given pair, when complemented by the corresponding panel section of the superimposed upper member of the same pair as well as by the corresponding quarter-panel sections of the capital members of another pair, are shaped to form a substantially rectangular, or square, panel with a central opening therethrough.

The general principles of the invention are also applicable to ceiling systems. A ceiling according to the invention may be formed, for example, by a slab of reinforced concrete with a plurality of structural portions of enlarged cross section which have upwardly extending edges terminating in a horizontal plane and, therebetween, a repetitive pattern of concave surfaces. These surfaces overlie, and communicate with, a likewise repetitive pattern of openings which extend transversely through the slab between the structural portions. A floor panel, preferably made of light-weight concrete, is placed on top of the concrete slab to be supported by the edges of its structural portions, and the space between the floor panel and the concave surfaces is filled with light-weight heat insulating material. This technique results in a system which has no false ceiling and which lends itself well for use in conjunction with acoustical or indirect lighting fixtures.

BRIEF DESCRIPTION OF THE DRAWINGS

Specific embodiments of the invention will now be described with reference to the accompanying drawings, in which:

FIG. 2 shows a modification of the panel design of FIG. 1, in which two sides of the panel are longer than the other two sides and in which two openings of intermediate size are additionally formed along one of the shorter sides.

FIG. 3 shows a three-dimensional structural system which two panels according to the invention, each formed of two half-portions facing each other end to end, are disposed in mutually perpendicular planes.

FIG. 4 illustrates a three-dimensional structural system in which a pair of panels embodying the principles of the invention are arranged back to back, with other panel members extending perpendicularly from the line of junction of the two panels and with slabs overlying and underlying the assembly.

DETAILED DESCRIPTION

Figure 1A:
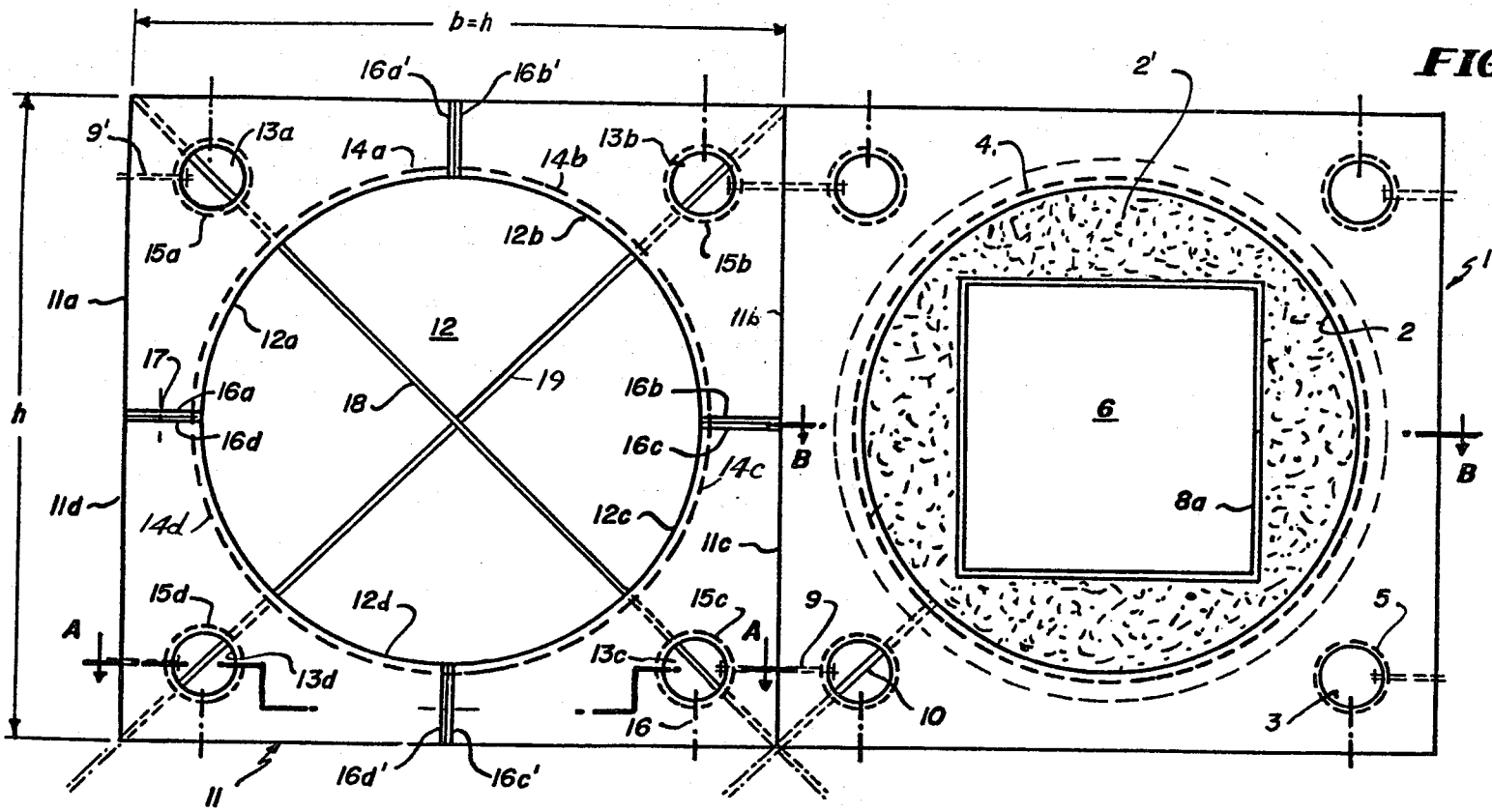
FIGS. 1A and 1B show, in elevation and in cross section respectively, two square panels according to the invention mounted side by side, each panel having a large central opening and four small corner openings; the panel shown to the left is a composite panel made up of four quarter sections while that to the right is of unitary construction.
Figure 1B:
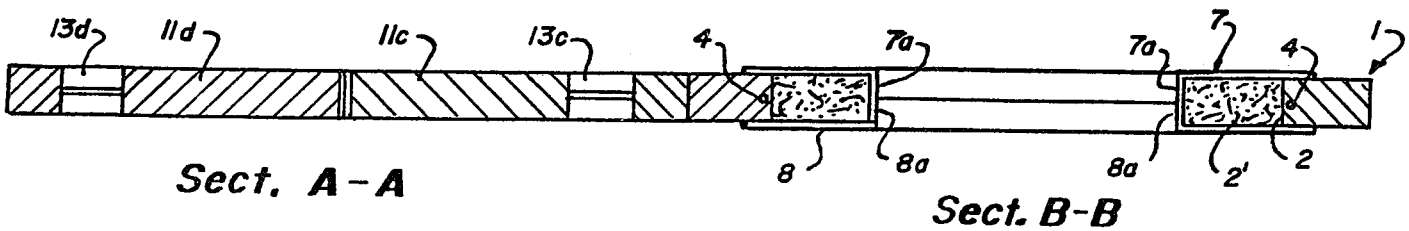

FIGS. 1A and 1B show, the former in elevation and the latter in sections taken in the direction of arrows A—A and B—B, a pair of modular building components according to the invention, each in the form of a rectangular panel of conventional concrete. In the drawing it has been assumed that for each of these panels the width b is equal to the height h; in short, both of these panels are of square shape but this is not a necessary requirement. In a typical case b and h may be equal to three meters and the thickness of the panels depends on the loads to which they are subjected and on their sectional structure. Panels of the general type shown herein are suitable for use in homes as well as office buildings but they may also be applied to buildings of other kinds.

Panel 1 shown in the right portion of FIGS. 1A and 1B and panel 11 shown in the left portion of these figures differ from each other primarily in that the latter is a composite of four quarter-panels whereas the former is of unitary design. Referring first to panel 1, it will be seen that this panel has a relatively large central opening 2 and in each of its four corners four relatively small openings 3; all of these five openings extend transversely through the panel.

Embedded in the concrete of the panel is a reinforcement, for instance in the form of one or more steel rods, which, as shown, surrounds central opening 2 circumferentially. Diagonally passed through the left-hand bottom corner of panel 1 and through the small opening 3 in that corner after manufacture of the panel is a steel bracing 10 which may be further extended as indicated, to secure panel 1 to a bottom slab or foundation (not shown). In addition, there are provided various steel ties 9 which are likewise passed through the panel and which terminate in a corresponding one of the small openings 3.

From the foregoing it will be appreciated that the light weight of the modular building component shown is due to the provision of the large central opening 2 and the relatively small corner openings 3. The various openings are designed in such a way that vertical loads on the panel are met with a minimum of concrete cross section and laterally acting forces with a minimum amount of steel reinforcement. Typically the weight of the panel is approximately one-third of a corresponding massive concrete panel of the same external dimensions, assuming that in both cases conventional aggregates and conventional steel are used. The circumferential steel reinforcements, therefore, serve to evenly distribute the vertical loads to the bottom of the panel and thence to structure or footing on which the panel rests.

As indicated above, the diagonal members 10—and similarly 18 and 19 in the left portion of FIG. 1A—act as bracings and they are used only where they are statically needed. It will further be clear from the foregoing that the small openings 3—and similarly 13*a*—13*d* in the left portion of FIG. 1A—have the dual function of reducing the weight of the panel and providing a convenient location for fastening the panels together and to other adjacent structure to provide an overall rigid system.

The relatively large central opening 2 is closed on its two sides by covers 7 and 8 respectively. The outside cover 7 which has been assumed removed in FIG. 1A preferably is made from a rainproof material; for example, it may be in the form of an aluminum or steel finish or an asbestos cement layer. The inside cover 8 may be made from gypsum board or some similar covering. The space between covers 7 and 8 inside opening 2 is filled with heat insulating material 2' such as glass wool or polystyrene. For improved heat insulation properties the interior cover 8 may be extended to cover the whole panel (not particularly shown in the drawing).

It will be noted from FIGS. 1A and 1B that covers 7 and 8 have flanges 7*a* and 8*a* respectively formed thereon which extend inwardly in abutting relation with respect to each other so as to form a window 6 of square shape. Flanges 7*a* and 8*a* serve to retain heat insulating material 2' in opening 2 outside of the window frame thus formed. While frame portions 7*a* and 8*a* have been assumed in the drawing to be integral parts of covers 7 and 8 respectively, it is also possible to use separate elements for these parts. Moreover, while the circular form of the various openings 2 and 3 is the most suitable and economical one for the transformation of forces within the panel, other configurations, for example hexagonal, hectagonal, parabolic or the like forms, could be employed depending on the particular application.

Reverting now to panel 11 shown on the left side of FIGS. 1A and 1B, this panel is composed of four individual arcuate sections 11*a*, 11*b*, 11*c* and 11*d* such that upon assembly the four arcuate surfaces 12*a*, 12*b*, 12*c* and 12*d* leave a large opening 12 in the center of the composite panel. Each of the aforementioned arcuate sections again has a relatively small corner opening therein, these small openings being designated as 13*a*, 13*b*, 13*c* and 13*d*. In this instance the reinforcements are in the form of part-circumferential steel reinforcements 14*a*, 14*b*, 14*c* and 14*d* embedded in the four quarter-panels respectively so as to extend about central opening 12.

In the case of quarter-panel 11*a* the reinforcement 14*a* is secured, such as by welding, as its two ends to terminating plates 16*a*, 16*a'* respectively. Similarly, reinforcement 14*b* is welded to terminating plates 16*b*, 16*b'*, reinforcing member 14*c* to terminating plates 16*c*, 16*c'* and reinforcing member 14*d* to terminating plates 16*d*, 16*d'*. The abutting terminating plates of each pair are then welded together to produce a panel 11. Diagonal bracings, here designated as 18 and 19, may be provided for a purpose similar to that of bracing 10 except that in this instance each of these bracings extends clear across the square panel between opposite corners thereof and that these diagonal bracings furthermore extend all the way through the central opening 12, in addition to the small openings involved. Again steel ties 16 similar to ties 9 referred to above are used to connect the panel to adjacent structural elements.

Although panel 11, FIGS. 1A, 1B, has been illustrated as being composed of four quarter-panels, it is possible instead to form the composite panel from two half-panels which in this case would generally be of C-shape. The technique of making the panel up from individual sections rather than using a panel of unitary design such as shown in the right-hand portion of FIGS. 1A, 1B, has the advantage that it facilitates handling and avoids the use of heavy lifting or hoisting machinery such as cranes or lift trucks. The fact that the panel according to the present invention readily lends itself to such a composite design considerably enhances its range of application and its economic benefits. It will be appreciated therefore that the manufacturing and processing of prefabricated concrete structures according to the invention are very simple, that this system permits the employment of unskilled labor and that its utilization is thus extended to countries or locations where the prior art systems must be considered unpracticable.

FIG. 2 shows a modification of the general panel design according to FIGS. 1A and 1B, in which the lengths of the panel is greater than its height. In order to further reduce the weight of the panel in this instance the panel, 21, in addition to the large opening 22 and the four small openings 23, is provided with two intermediate size transverse openings 23' which extend along one of the shorter sides of the panel as shown. The four small openings 23 have the same location relatively to the large opening 22 as they had in the case of FIG. 1 so that also in this instance bracings analogous to bracings 10, 18 or 19 can be passed through them diagonally to secure the panel to adjacent panels or other structures.

As indicated above, the principles of the invention are also applicable to three-dimensional or multi-planar systems. The first example of such an application is shown in FIG. 3 wherein two panels, each comprising two-half portions meeting at their narrow ends are arranged in mutually perpendicular planes.

More specifically, the first of these panels consists of a generally C-shaped half-portion 31*a* having a substantially semicircular inner surface 32*a* and two small transverse openings 33*a*, 33*a'* in its corner; and a cooperating second half-portion 31*b* with a semicircular inner surface 32*b* and two small corner openings 33*b* and 33*b'*. Similarly the other, perpendicular panel is comprised of a half-portion 31*c* with a semicircular inner surface 32*c* and corner openings 33*c'* and a cooperating half-portion 31*d* with an inner semicircular surface 32*d* and corner openings 33*d*, 33*d'*. It will be clear from the drawing that in each of these two perpendicularly related panels the two semicircular inner surfaces complement each other to form a relatively large, circular central opening. The various panel portions may have steel reinforcements embedded therein circumferentially of these various large and small openings, and may have steel ties or bracings passed therethrough, as in the case of FIG. 1, but these details have been omitted from the showing of FIG. 3 as well as the subsequent figures. Whether the cooperating half-portions, 31*a*–31*b* and 31*c*–31*d*, are formed of separate sections or not is of no significance. One possible implementation, for example, would be to provide a square panel 31*c*–31*d* of unitary design and the length b, and let the panel be perpendicularly abutted by the separate sections 31*a*–31*d* each of a length slightly less than b/2, or vice versa. The term "half-portion" as used herein is meant to apply to each of parts 31*a*, 31*b*, 31*c*, 31*d* regardless of the manner in which the cruciform configuration is produced.

The entire cruciform structure is overlaid by and carries a slab 30 as shown. In FIGS. 3 the sides of this slab extend in planes parallel to the respective planes of the two mutually perpendicular panels. It goes without saying, however, that it is also possible to place slab 30 on top of the two panels at a different angle, for example, in such a way that its sides come to lie in planes diagonally intersecting the planes of the two panels.

While in FIG. 3 the means for joining separate panel sections to each other and to slab 30 have not been shown, some of the techniques illustrated in the modified space system of FIG. 4 may be employed for this purpose.

Turning now specifically to FIG. 4 the multiplanar system shown therein is somewhat similar to that illustrated in FIG. 3, with the principal difference that in this case the panels or panel sections are assembled back to back rather than disposed end to end. The panel element 41 shown on the right side of FIG. 4 is, as will be noted, similar in design to the panel portions of FIG. 3. However, as indicated by the broken off ends of the "C" shown, element 41 could equally be a full panel such as panel 1 of FIG. 1. At any rate this panel element 41 has relatively small corner openings 43*a* and it is also designed to define a relatively large central opening 42.

Mounted in the same plane with panel element 41 is another panel element 44 which may be of the same design as element 41 but this is not an indispensable requirement.

Assembled in perpendicular relationship to panel elements 41, 44 so as to meet them perpendicularly along their line of abutment is a further panel member 46. The drawing also indicates how a similar member 46' continues panel member 46 into the next higher tier or story of the structural system or building. As likewise shown in FIG. 4, panel 46 has somewhat concave sides such that its top and bottom portions are slightly wider than its center. This is in order to allow for the formation at the top and bottom of the member, of ribs 48 and 48' respectively, and reduce the weight of the panel where permitted by the design. Thus the surfaces of the panels are not necessarily flat, their shape being determined by the design requirements of each individual case. This feature provides more flexibility and gives the invention a wider range of application. A similar rib 48'' is formed along the bottom of the other panel member 46'. Top slabs 47*a* and 47*b* which overlie panel elements 41, 44 and panel member 46, and bottom slab 47' which underlies this vertically extending structure, enter the recesses or shoulders formed by ribs 48, 48' and 48'' so that the slabs are in effect dovetailed with respect to panel members 46, 46'. These connections are supplemented by steel ties 49*c* and 49*d* embodied in the respective parts as shown. FIG. 4 also illustrates how the two panel elements 41 and 44 are held together by other steel ties 49 terminating in small openings 43*a* and 43*b* of the panel elements and how steel ties 49*a*, 49*b*, 49*a'* and 49*b'*, also terminating at one end in the aforementioned small openings, are used to secure the various slabs rigidly to these panel elements and vice versa.

Figures 5A, 5B:
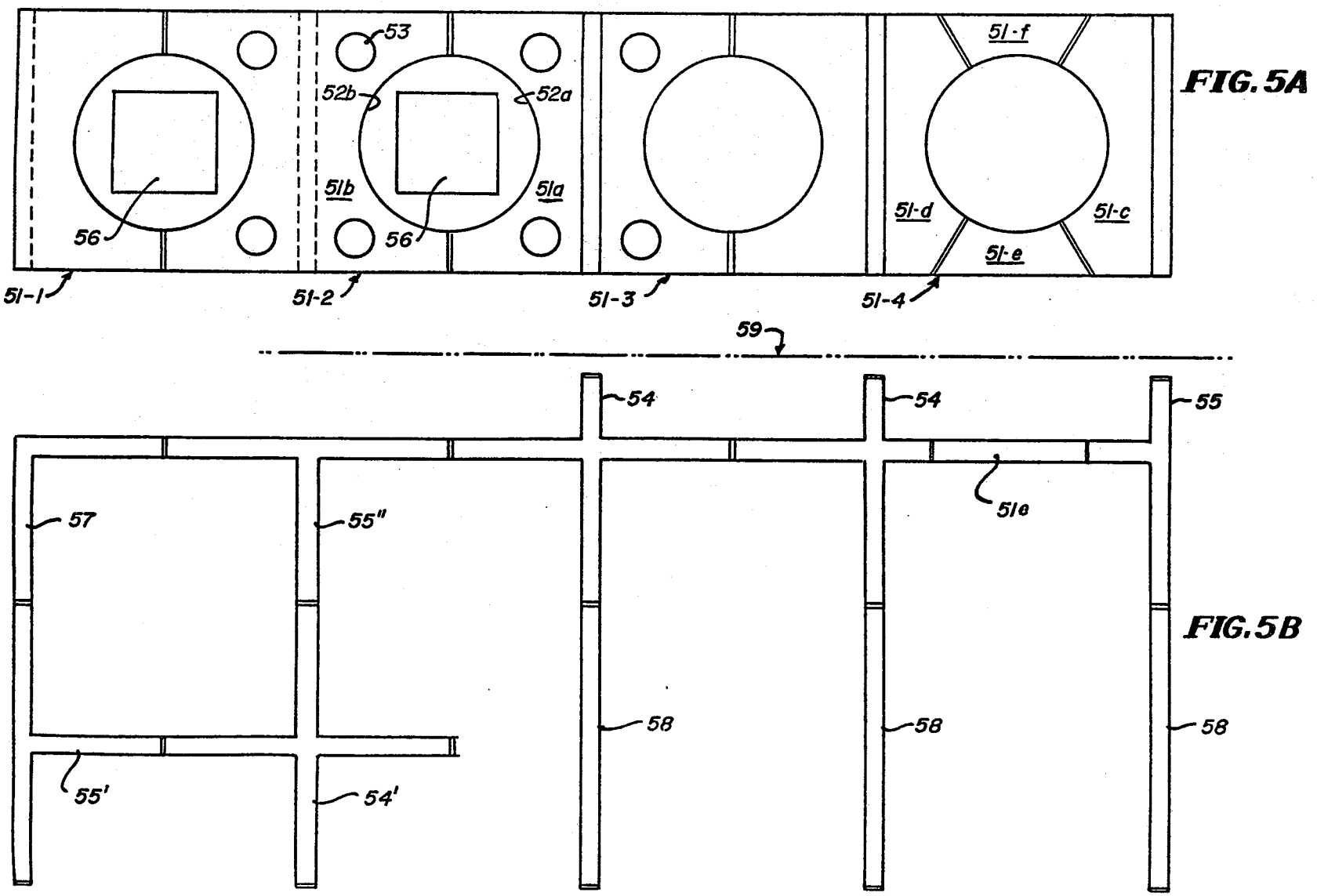
FIGS. 5A and 5B show, in elevation and plan view respectively, a three-dimensional structural system including a series of coplanar panels designed according to the principles of the invention and joined to column structure of different cross-sectional configuration.

FIGS. 5A and 5B illustrate another way of applying panels or panel sections of the general type shown in FIG. 1 to a three-dimensional structural system. As more particularly shown in FIG. 5A, a series of such square panels 51-1, 51-2, 51-3, 51-4, each of them assumed to be composed of complementary sections, are aligned next to each other in a common plane. Panel 51-2, for example, is shown as being composed of half-sections 51*a* and 51*b*, each having small transverse openings 53 therein and defining between arcuate portions 52*a* and 52*b* a relatively large, transverse circular opening having a square window 56 therein which is also formed of two halves.

If panel 51-2 were, instead, formed of four quarter sections, then the window in this panel would be correspondingly composed of four quarters. Whatever the number of sections, the form and size of the window would be chosen by the architect according to requirements. Panels 51-1, 51-3 and 51-4 are generally similar but they have been shown with some of the elements of panel 51-2 omitted. With particular reference to panel 51-4, the two principal sections 51-*c* and 51-*d* of this panel at their inner ends are shortened along diagonal lines so that these two panel sections do not abut each other. Instead, a pair of generally wedge-shaped panel sections 51-*e* and 51-*f* are interposed between the principal sections 51-*c* and 51-*d*. The advantages of this design will be explained in connection with the description of FIG. 8 below.

As shown in the floor plan, FIG. 5B, a variety of columnar portions are joined to the aforementioned coplanar series of panels to form a three-dimensional structural system. In fact as will be noted from the drawing, the individual panel sections shown in FIG. 5A themselves form portions of vertical structural components. For example, the left half-section of panel 51-1 is part of an L-shaped column member 57; the right hand section of panel 51-1 and the left hand section, 51*b*, of panel 51-2 are parts of a T-shaped column member 55''; the right hand section 52*a* of panel 51-2 and the left hand section of panel 51-3 form parts of a generally cruciform column member 54, this also being true for the right hand section of panel 51-3 and the left section of panel 51-4; and the right section of panel 51-4 is a part of a generally T-shaped column member 55. The aforementioned vertical members are joined by others shown in the lower portion of FIG. 5B. These other column members include T-shaped column member 55', cross-shaped column member 54' and panel-shaped column members 58. This entire column structure can then be overlaid by a slab somewhat analogous to slab 30, FIG. 3. While this slab has not been particularly shown in FIG. 5, line 59 indicates the extent of overhang of this slab over the upper end portions of column members 54 and 55 as viewed in FIG. 5B.

Figure 6:
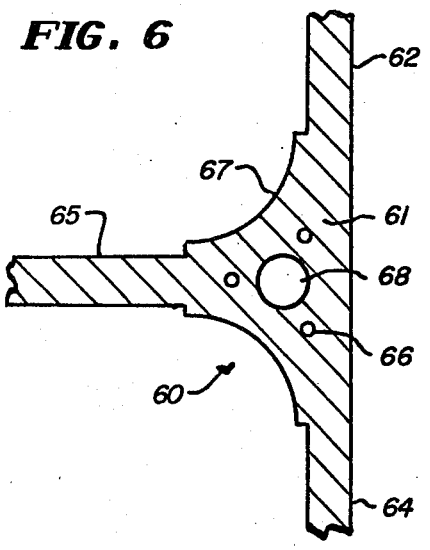
FIG. 6 is a sectional plan view of a capital member according to the invention, which has a T-shaped configuration.
Figure 7:
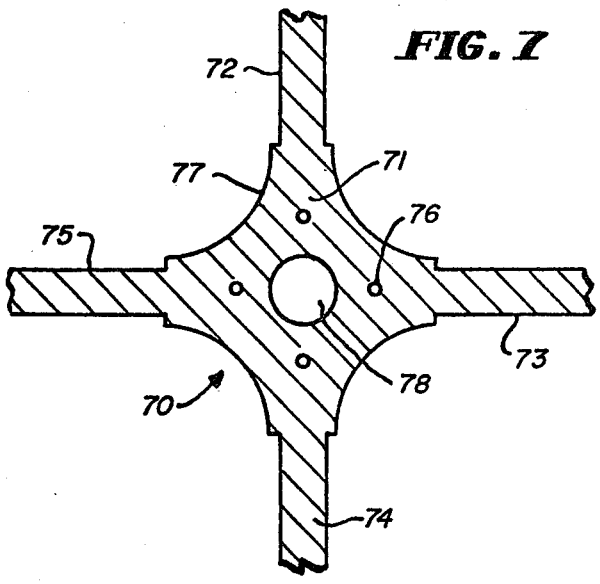
FIG. 7 is a sectional plan view of a capital member according to the invention, which has a cruciform configuration.
Figure 8:
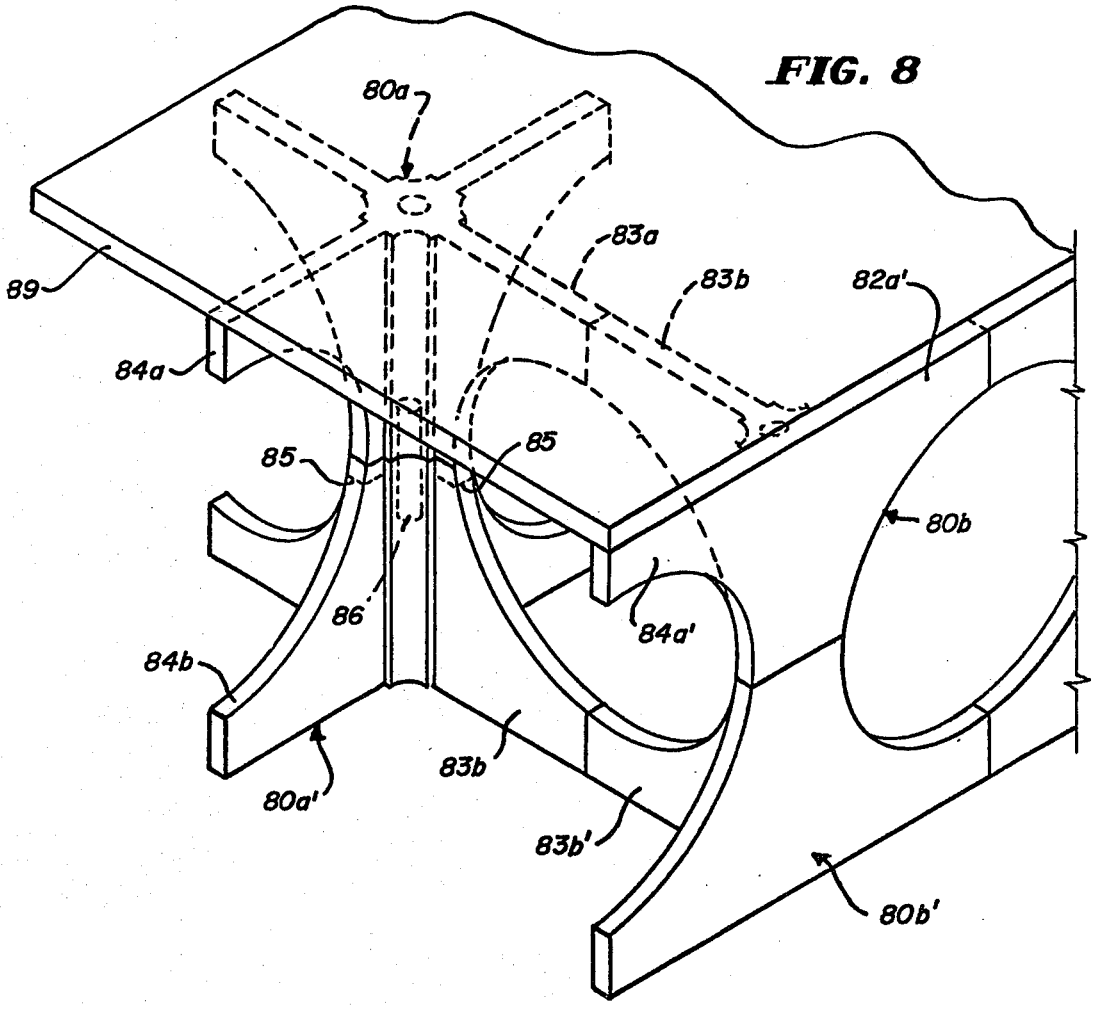
FIG. 8 shows in perspective a three-dimensional structural system embodying two pairs of capital members of the general kind illustrated in FIG. 7.

FIGS. 6 and 7 show "capital members"—a term defined above—of two different configurations, FIG. 6 illustrating a T-shaped capital member and FIG. 7 a cruciform member of this kind. FIG. 8 illustrates how members of the types shown in cross section in FIGS. 6 and 7, can be combined in an overall structural system exhibiting the features of the present invention.

The T-shaped capital member 60 of FIG. 6 has a central portion 61 from which arcuate panel sections 62, 64 and 65 extend, with panel section 65 lying in a plane perpendicular to that of sections 62 and 64. As will be clear from an inspection of FIG. 8, the panel sections, such as 62, 64 and 65 of these capital members are shaped somewhat like the quarter-panels shown in the left hand portion of FIG. 1. The rounded surfaces 67 between sections 62 and 65, and sections 64 and 65 are provided to yield a monolithic panel configuration of greater rigidity. The central portion 61 of this configuration is sufficiently large in cross section to permit the formation therein of a vertically extending cylindrical cavity 68 which reduces the weight of the capital member. The small circular cavities adjacent to cavity 68 may be used to receive coaxially extending steel members, for example poststressing bars 66, for securing the capital member to structural elements thereabove and /or therebelow where needed. It will be seen, therefore, that the design of the capital member itself in various respects follows the principles of the invention as described above in connection with FIG. 1.

The capital member 70 shown in FIG. 7 has four arcuate panel sections 72, 73, 74, 75 disposed at right angles to each other. In this case again, central section 71 has rounded surfaces 77 and has extending therethrough a cylindrical cavity 78 to reduce the weight of the capital member. The small circular cavities provide for the passage of post-stressing bars 76.

Turning now to FIG. 8, it will be noted that the structural system shown therein comprises a pair of cross-shaped capital members 80*a*, 80*a*′ and a pair of T-shaped capital members 80*b*, 80*b*′. The lower member, 80*a*′ of the first pair is, more strictly speaking, in the nature of a base member while the other member, 80*a*, of this pair is inverted with respect to member 80*a*′ and thus forms a capital member in the more narrow sense of the term. Capital members 80*b*′ and 80*b* of the other pair are similarly superimposed on each other in inverted relationship. Dotted lines 85 indicate how the abutting end surfaces of the eventually superposed capital members may be staggered to enhance rigidity. However, as shown at 86, the central portion at this section also is filled with reinforced concrete to bind the two capital members firmly together. The length of this section is a matter of design choice.

Each of these four capital members has integrally formed thereon arcuate quarter-panels which are angularly spaced from each other in accordance with the general teachings of FIGS. 6 and 7. Visible in FIG. 8 are quarter panels 83*a*, 84*a*, 83*b*, and 84*b* of the first pair of capital members and quarter-panels 82*a*′, 84*a*′, 82*b*′, 83*b*′ and 84*b*′ of the second pair of capital members.

As will be appreciated from the perspective showing of FIG. 8, certain ones of these quarter-panels of the various capital members complement each other to form square panels similar to those shown in FIG. 1, particularly in that the arcuate surfaces of these quarter-panel sections define between them a large central opening comparable to opening 12 in FIG. 1. No small openings corresponding to openings 13*a*–13*d*, FIG. 1, have been shown in the quarter-panels of FIG. 8. In this connection it should be noted that an additional weight reduction is provided by the cylindrical cavities, corresponding to cavities 68, FIG. 6, and 78, FIG. 7, in these capital members and that furthermore, post-stressing bars, corresponding to bars 66, FIG. 6 and bars 76, FIG. 7, meet the function of securing the capital members of each pair to each other and to adjacent structure so that steel ties, corresponding to ties 16, etc., FIG. 1, may be dispensed with if desired. The foregoing structural system is further complemented by the slab 89 which overlies, and is carried by, capital members 80*a* and 80*b* in overhanging fashion.

While FIG. 8 shows a combination of a pair of two capital members abutting each other at their narrow end, it is also possible to superimpose two such capital members at their wide ends. In fact, a multielement column of such capital members, relatively inverted in alternation, may be used in a manner not specifically shown in the drawings as a part of a multitier building structure.

In order to limit the size of the capital members to facilitate the hoisting operation the configuration shown in FIG. 5A at 51-4 may be applied to the formation of the panel sections of the capital members shown in FIG. 8. This configuration is of particular advantage in high-rise buildings and also where the capital member is of substantial dimensions, e.g. substantial height.

Figure 9A:
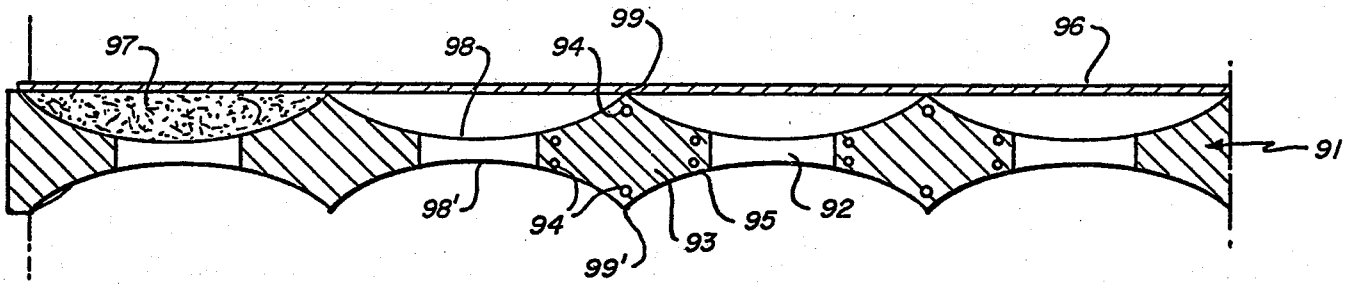
FIGS. 9A and 9B show in elevational cross section and in bottom view respectively a ceiling system according to the principles of the invention.
Figure 9B:
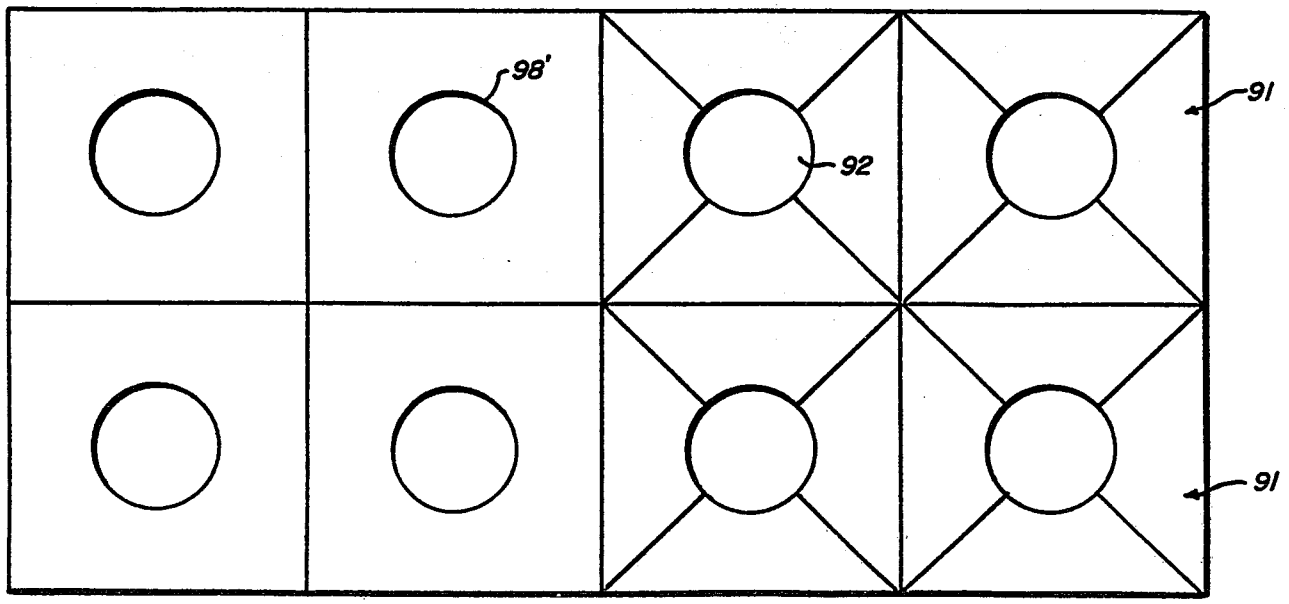

FIGS. 9A and 9B illustrate the application of the principles of the invention to a ceiling system. In FIG. 9A showing the ceiling system in elevational cross section, 91 is a modular component in the form of a horizontally extending ceiling slab of conventional concrete, which has portions 93 of enlarged cross section and reinforcements 94. Transverse, in this case vertically extending, openings 92 are provided in slab 91 between adjacent ones of its enlarged portions 93. These enlarged portions have arcuate surfaces 98, 98′ forming top edge portions 99 and bottom edge portions 99′ respectively. As shown in the drawing, the top edges 99 support the floor tile 96 which preferably is of light-weight concrete and may be of unitary or sectional design, and the spaces between the floor tile and the upper surfaces of enlarged sections 93 are filled with light-weight sound and heat insulating material 97 such as porous concrete. In order to prevent this insulating material from escaping through openings 92 the insulating material could either be prefabricated by molding or it could be poured in situ with a mesh covering the openings.

FIG. 9B which is a bottom view of the ceiling system, in its left-and-right-hand portions respectively, shows two different ways of implementing this system. In the left portion of FIG. 9B it is assumed that the arcuate surfaces 98′—and similarly arcuate surfaces 98 not visible in FIG. 9B—are of generally part-cylindrical barrel shape so that edges 99′, and similarly edges 99, merely extend along lines paralleling each other from the bottom to the top as viewed in FIG. 9B. The openings 92 between the enlarged portions 93 form a grid-like pattern in this part of FIG. 9B. In the right half of FIG. 9B openings 92 form a corresponding grid but in this part of the figure the lines defining the edges 99′ (and 99) themselves form a cross-coordinate pattern each cell of which has the general character of a groined vaulting terminating in the corresponding opening 92.

In both of these implementations the openings 92—the size of which depends on the loads acting on the ceiling system—, as well as the use of the light-weight insulating material thereabove, reduce the weight of the ceiling system. The system can be supplemented, in a manner not particularly shown in the drawing, by indirect lighting fixtures and/or acoustical fixtures provided underneath slab 91. As regards the former, light emanating from the indirect lighting fixtures is reflected by arcuate surfaces 95, and also by the exposed center portions of insulating material 97 which reflect the light impinging thereon through openings 92 in slab 91. It will be appreciated that a great variety of lighting effects can be produced in this fashion.

It may be added that while the ceiling system as shown in FIG. 9 is designed to present a cross-coordinate matrix of openings 92—and, in the right portion of FIG. 9B, also of groined vaultings—it is also possible to subdivide the ceiling in accordance with other, for example, hexagonal or octagonal, repetitive patterns.

From the foregoing description it will be appreciated that the invention can be incorporated in a great variety of both uniplanar and multiplanar structural systems. In all of these cases the design according to the invention while providing greater rigidity results in a considerable saving in weight and hence material and handling costs; it facilitates modular design and prefabrication; and it extends the geographic range of applicability of these systems.

It should thus be understood that the embodiments described herein are merely in the form of examples and that they are not intended to limit the scope of the invention. It may be mentioned specifically that all the panels or three-dimensional members involved may be subjected to poststressing if this is called for by the design parameters; the vertically loaded three-dimensional members may also be precast and prefabricated. Furthermore, angles other than 90° or 180°, for example 120° angles, may be used between the individual panels or panel sections of these members.

I claim:

1. In a multiplanar structural system, a capital member of concrete having an axially extending central portion and having, integrally formed therewith a plurality of arcuate quarter-panel wall sections extending radially from said central portion in planes mutually intersecting along the axis of said member, each said arcuate quarter-panel wall section extending over a circular arc of substantially 90°, and having two end faces disposed for cooperation with the end faces of complementary arcuate quarter-panel wall sections of similar, vertically and horizontally adjacent capital members so that when said first-mentioned arcuate quarter-panel wall section is joined in coplanar, generally end-to-end abutting relationship to the arcuate quarter-panel wall sections of said similar members, the quarter-panel wall sections so joined form themselves a substantially rectangular, vertical-and-horizontal-load bearing wall panel with a central, weight reducing circular opening therethrough.

2. In a multiplanar structural system, a capital member as claimed in claim 1, wherein said member has a cavity in and coaxial with said central portion, other relatively smaller cavities and post stressing means extending in and lengthwise of said cavities.

3. In a multiplanar structural system, two pairs of capital members of concrete each having a tapered end and a flared end, the two members of each said pair being mutually superimposed so as to abut at their tapered ends, each said member having an axially extending central portion and having, integrally formed therewith, a plurality of arcuate quarter-panel sections extending radially from said central portion in planes mutually intersecting along the axis of said member, each said quarter-panel section being shaped to form, when complemented by the corresponding quarter-panel section of the superimposed capital member of the same pair as well as by the corresponding quarter-panel sections of the capital members of the other pair, a substantially rectangular panel with a central opening therethrough.

* * * * *